United States Patent [19]

Purohit

[11] Patent Number: 5,007,533

[45] Date of Patent: Apr. 16, 1991

[54] WET BLADE RAZOR STORAGE APPARATUS

[75] Inventor: Ahnal A. Purohit, Lisle, Ill.

[73] Assignee: Anshal, Inc., Darien, Ill.

[21] Appl. No.: 495,471

[22] Filed: Mar. 19, 1990

[51] Int. Cl.[5] ..... B65D 81/22; B65D 81/24

[52] U.S. Cl. ..... 206/208; 206/352; 206/228; 134/162

[58] Field of Search ..... 206/208, 209, 209.1, 206/207, 352, 354, 355, 228; 134/162

[56] References Cited

U.S. PATENT DOCUMENTS

| | | | |
|---|---|---|---|
| 1,189,118 | 6/1916 | Jonas | 206/208 |
| 1,912,627 | 6/1933 | Dyer | 206/208 |
| 1,963,563 | 6/1934 | Slepicka | 134/162 X |
| 1,981,853 | 11/1934 | Bruce | 206/208 |
| 2,177,815 | 10/1939 | Strock | 206/208 X |
| 2,443,495 | 6/1948 | De Tuesta | 206/208 |
| 2,449,818 | 9/1948 | Olsen | 134/162 X |
| 2,853,085 | 9/1958 | Torkelson | 134/162 X |
| 3,019,494 | 2/1962 | Horie et al. | 206/208 |
| 3,352,630 | 11/1967 | Fischer | 206/208 |

FOREIGN PATENT DOCUMENTS

| | | | |
|---|---|---|---|
| 275422 | 8/1927 | United Kingdom | 206/208 |
| 294274 | 7/1928 | United Kingdom | 206/208 |

*Primary Examiner*—Paul T. Sewell
*Assistant Examiner*—Jacob K. Ackun, Jr.
*Attorney, Agent, or Firm*—Charles F. Lind

[57] ABSTRACT

An open-top vessel having a closure cap, and a razor holder for releasably supporting a water rinsed razor and its blade within the vessel spaced below the closure cap. The vessel may be filled with mineral oil to a level above the blade, to have the blade submerged in the mineral oil. The razor holder may be supported on the closure cap, and rotatable via an exposed handle, for moving the razor as submerged in the mineral oil. More than one vessel may be used, as a kit, with each additional vessel also having a closure cap, a razor holder, and handle; and one or more vessels may be filled with mineral oil and one or more vessels may be left empty. The razor may be moved from vessel to vessel successively as it is being treated with the mineral oil and stored.

11 Claims, 1 Drawing Sheet

WET BLADE RAZOR STORAGE APPARATUS

BACKGROUND OF THE INVENTION

Wet blade razors, or the type used with a wet lather or shaving cream, generally is presumed to have a useful life only one or at most several shaves. Thereafter, the shaver feels uneven pulling of the blade against the skin or sees and feels that the shave is not close. In fact, the blade does lose its cutting edge very fast.

Many factors are believed to contribute to the short useful life of a wet razor, including: (1) physical wear on the cutting edge caused by dragging it across the skin and actually cutting the hairs; and (2) exposure of the cutting edge to the lather or shaving cream and to the water, during shaving, and possible chemical oxidation of the blade that occurs then.

The inventor herein has determined that the above-listed factors actually contribute an insignificant percentage, toward the short useful life of a wet razor. The real culprit is chemical oxidation that occurs after the shaving has been completed, the blade and razor has been rinsed clean with water, and the razor is set aside and stored until the next time for shaving. During this period, exposure of the razor blade to the atmospheric air promotes chemical oxidation of the blade's cutting edge, that dulls it many times faster than during shaving itself.

SUMMARY OF THE INVENTION

This invention relates to apparatus to allow storage of the wet blade razor between the times it is actually to be used.

One object of the present invention is to provide apparatus suited to store the razor during nonuse, so as to preserve the blade's cutting edge so as to retain its sharpness and extend its useful life.

To achieve these and other objects, the present invention may provide an open-top vessel, and closure means for the vessel. Razor holding means may releasibly support the razor and its blade within the vessel spaced below the closure means. The vessel may be filled with mineral oil to a level above the blade, to have the blade submerged in said mineral oil. The razor holding means may further be supported relative to the closure means operable to rotate the razor as held submerged in the mineral oil. A handle exposed from the exterior of the closure means may be manually powered for so rotating the razor. The razor holding means may be resilient grippers, such as O-rings supported in a bore, adapted to surround and releasibly cooperate with the razor handle.

More than one vessel may be used, as a kit, with each additional vessel also having closure means, razor holding means, and handle, suitable for holding the razor in the vessel and moving the razor from outside of the vessel. With the multiple vessel kit, each vessel may be filled with mineral oil, and the razor may be successively treated in the separate vessels, the first vessel for initially exposing the razor to the mineral oil and the second vessel for then storing the cleaned and mineral oil treated razor in fresh mineral oil. Alternatively, one or more vessels in a multiple vessel kit may be filled with mineral oil for treating the razor, while one or more vessels may be empty; where in one sequence a water rinsed razor may first be spun dry in a first empty vessel prior to being treated in a mineral oil filled vessels, or in another sequence a razor treated in a mineral oil filled vessel may then be stored in air in a last empty vessel.

BRIEF DISCRIPTION OF THE DRAWINGS

Further objects, advantages and features of the present invention will appear from the following disclosure and description, including as a part thereof the accompanyinq drawing, in which.

DETAILED DESCRIPTION OF ILLUSTRATED EMBODIMENTS

Figure 1:
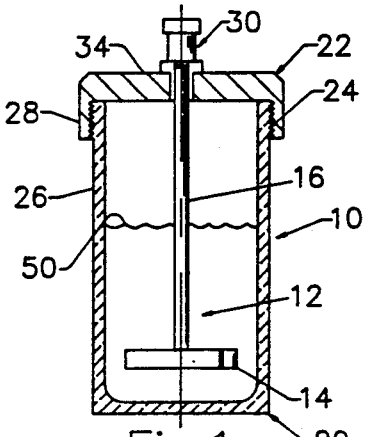
FIG. 1 is an elevational sectional view of a first embodiment of storage apparatus to be disclosed herein.

FIG. 1 shows apparatus 10 for storing, during nonuse, a wet razor 12 having a blade end 14 and a handle 16 cantilevered away from the blade end. Any popular wet razor can be benefitted when used with the apparatus, so that the razor may have a single or multiple blade construction, a single or double edge blade, or a fixed or adjustable blade exposure or angle mounting feature.

The apparatus 10 has an open-top liquid-tight vessel 20, and a closure means or cap 22 for covering the vessel top. The connection 24 between the vessel 20 and cap 22 is illustrated as mating conventional screw-type threads formed on the telescoping axially extended vessel and cap side walls 26 and 28; although alternative constructions may be used, including quick-connect mating pin and groove lock means (not shown) which can be locked or unlocked with less than one-quarter turn of the cap relative to the vessel.

Figure 2:
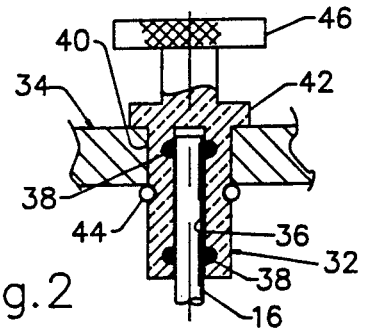
FIG. 2 is an enlarged fragmentary section showing additional details of the mounting of the razor in the apparatus and the rotational aspect of the mounting.

Razor holding means 30 is formed in the apparatus 10, shown in FIG. 2 as a plug member 32 carried on the cross wall 34 of the closure cap 22. The plug member 32 will have a closed end bore 36 sufficiently large to receive the free end of the razor handle 16; and a retaining lock means in the form of spaced O-rings 38 contained in shallow annular recesses in the plug member adjacent the bore, fit snuggly around the razor handle 16 so as to releasably secure it as so positioned. A set screw (not shown) threaded into a tap in the plug member 32 can be used also, or alternatively, being tightened against the razor handle 16.

The plug member 32 moreover has a cylindrical exterior fitted in a cylindrical opening 40 in the cap cross wall 34, so as to be rotatable around an axis substantially normal to the cap wall. The plug member 32 may have an upper flange 42 suited to rest on the top surface of the cap cross wall, and an O-ring 44 contained in an annular recess in the outside surface of the plug member adjacent the underside of the cap cross wall, so as to axially lock the plug member relative to the cap cross wall.

An enlarged cylindrical handle 46 is keyed to the plug member 32, suited to be gripped between the shaver's thumb and fingers for rapidly rotating the plug member 32 and/or oscillating it back and forth. The razor holding means 30 in the plug member 32 will be effective to key the razor handle nonrotatably relative to the plug member, such as by shaping the bore 36 in a rectangular shape to key a correspondingly shaped razor handle 16 and/or by the tightness of the gripping O-rings 38 and/or by the tightness of the set screw 39. Thus, the razor 12 rotates as the razor holding means 30 is rotated.

The invention provides the use, with the apparatus so far disclosed, of mineral oil stored in the vessel 20 to a level such as indicated by line 50, above the blade end 14 so as to have the cutting edge (not shown) of the razor blade submerged in said mineral oil during storage. Moreover, a hygroscopic material, such as pellets of calcium chloride ($CaCl_2$) may be contained in the mineral oil, on the bottom wall 48 of the vessel in the region spaced below the blade end 14. A mineral oil having a light to medium viscosity might be preferred.

For using the invention, the shaver would remove the cap 22 from the vessel 20 in order to remove the razor 12 from the razor holding means 30, as needed during shaving. Any mineral oil on the razor can be rinsed off, if desired, although the presence of the oil does seem to ease any feeling of blade drag while shaving. After shaving, the shaver would water rinse the razor clean, shake it dry, position it in the razor holding means 30, and position the held razor in the vessel 20 by closing the cap 22 on the vessel.

As the razor 12 is so held in the vessel 20, the blade end 14 is submerged in the mineral oil, close to but spaced above any hygroscopic material contained also in the vessel. The shaver would then rapidly spin the positioned razor 12 by gripping the handle 46 between the thumb and fingers, and/or would rapidly oscillate the razor. This action would centrifically throw off excess water from the razor, and would force the mineral oil into encompassing relationship on all exposed parts of the razor and particularly at and over the cutting edge of the blade.

Any water spun off of the razor will be absorbed by the hygroscopic material, or would in time sink to the bottom of the mineral oil as it is more dense than the mineral oil. The mineral oil, in this encompassing relationship on and over the blade edge, serves to preserve the sharpness of the cutting edge. The inventor has observed that razors stored in this manner between shaves, can be used for several months of daily shaves with the feel and comfort of a new razor.

Figure 3:
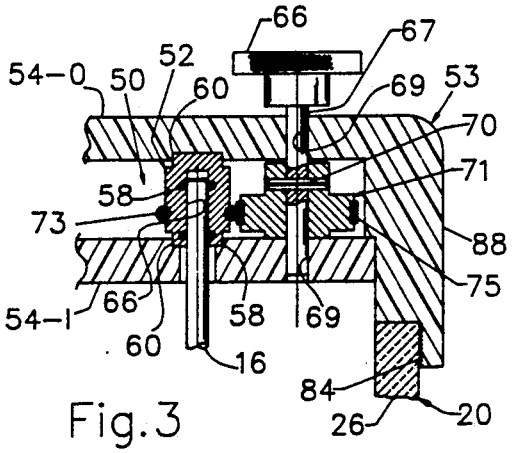
FIG. 3 is an enlarged fragmentary section similar to FIG. 2, except showing a second embodiment of the storage apparatus.

FIG. 3 illustrates a modified razor holding means 50, formed as a plug member 52 carried between cross walls 54-O and 54-I of the closure cap 53. The plug member 52 will have a closed end bore 66 sufficiently large to receive the free end of the razor handle 16; and a retaining lock means in the form of O-rings 58 contained in shallow annular recesses in the plug member adjacent the bore, fit snuggly around the razor handle 16 so as to releasably secure it as so positioned.

The plug member 52 moreover has opposing cylindrical exterior bearings fitted in cylindrical recesses 60 in the cap cross walls 54-O and 54-I, so as to be rotatable around an axis substantially normal to the cross walls.

An enlarged cylindrical handle 66 is keyed to shaft 67 extended through beearing openings 69 in the cap cross walls 54-O and 54-I, and a drive member 71 is keyed to this shaft by pin 70 to lie between the cap cross walls. Friction bands 73 and 75 are fitted in appropriate recesses in the plug and drive members 52 and 71, and these bands have generally cylindrical exterior shapes and engage one another so as to key the plug and drive members 52 and 71 together rotatably. The drive member friction band 75 is larger than the plug member band 73, to provide a motion multiplier between the rotations of the handle 66 and the plug member 52.

The closure cap 53 will likewise be secured as by connection 84 between the telescoping cylindrical side walls 88 and 26 of the vessel 20, to close the open top of the vessel and hold the razor 16 secured thereto with its blade end (not shown) suspended inside the vessel. The inner cap cross walls 54-I may be press-fit within the cap side wall 26, against shoulder 89 thereon.

The primary advantage of this embodiment of closure cap 53 is the motion multiplier drive between the drive and plug members 71 and 52 respectively offers the possibilty of spinning the razor, as submerged in the mineral oil, at a more rapid rate, tending then to even more completely encompass the razor within the mineral oil.

While the invention can be practiced with only a single vessel of mineral oil, there are possible advantages of useing several vessels, and advancing the razor successively through the vessels after shaving with the razor for cleaning and for storing the razor until needed again.

Figure 4:
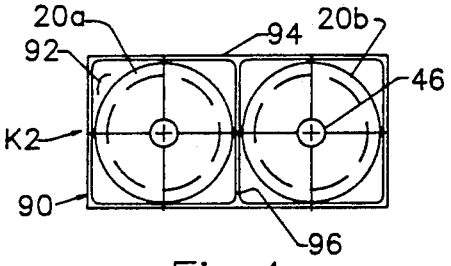
FIG. 4 is a top plan view of a kit type grouping of two storage apparatus of the type illustrated in FIGS. 1–3, as might be used in a preferred mode of use.

FIG. 4 shows as a top plan view a kit K2 grouping of two vessels **20*a* and 20*b*, held by a tray 90 in adjacent side-by-side relationship. The tray 90 may have a flat base wall 92 and a peripherial wall 94 upstanding from the base wall, and a single partition wall 96 also upstanding from the base wall and extended between the peripherial wall at a location to separate the vessels 20*a* and 20*b* from one another. The height of each upstanding wall 94 and 96 may be slight, possibly only a fraction of an inch above the base wall 92**.

In this kit K2, each vessel **20*a* and 20*b* would be used to hold some mineral oil and hygroscopic material; but in order to extend the life of the mineral oil, one vessel 20*a* would be used first after the razor had been water rinsed clean under a faucet to work the mineral oil onto the razor surfaces and the other vessel 20*b* would be used to store the razor. As much of the water and other impurities on the razor surfaces would be removed in the vessel 20*a*, the operating life of the mineral oil in the second vessel 20*b* would be very long, in excess of several months. The mineral oil may have to be changed more frequently in the rinse vessel 20; but water separated out and at the bottom of the vessel can with care be extracted to extend the operating life of the mineral oil in the rinse vessel 20*a***.

It would also be possible to leave the first vessel **20*a* empty, without any mineral oil, for merely centrifically spining off the excess water from the surfaces of the used but water rinsed razor. It would also be possible instead to leave the second vessel 20*b* empty, without any mineral oil, for storing the mineral oil covered razor in air, after it had been rinsed in the mineral oil bath in vessel 20*a*. Excess mineral oil could then drip from the razor and be collected in the vessel 20*b*, and reused in vessel 20*a***. Air storage may be advantageous to preclude possible long-term corrosive interchange between the razor handle or other structures and the mineral oil, depending on the materials used in such razor structures.

In this kit K2, caps 22 as disclosed in FIGS. 1 and 2 can be used on both the rinse and storage vessels, with a direct linkage between the operating handle 46 and the suspended razor (not shown in this figure).

Figure 5:
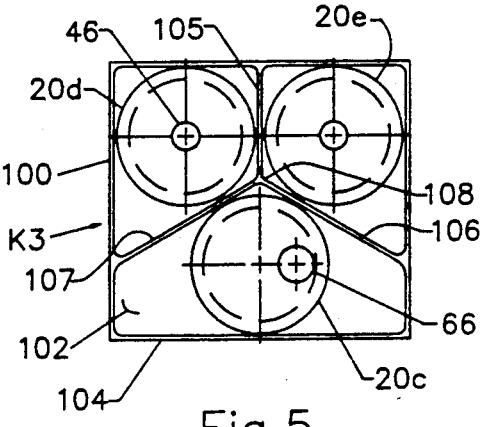

FIG. 5 shows as a top plan view a kit K3 grouping of three vessels 20*c*, 20*d* and 20*e*, held by a tray 100 in a side-by-side triangular relationship. The tray 100 may have a flat base wall 102 and a peripherial wall 104 upstanding from the base wall, and three partition walls 105, 106 and 107 also upstanding from the base wall and each extended from one side of the peripherial wall to a central common location 108. Again, the height of each upstanding wall need only be slight.

In kit K3, vessel 20*c* could be empty for merely centrifically spining off the excess water from the surfaces of the used water rinsed razor; while each vessel 20*d* and 20*e* would hold some mineral oil and hygroscopic material. The vessels would be used in a predetermined order, vessel 20*c* to remove excess water mechanically; vessels 20*d* next to flush remaining water off the razor and to work the mineral oil onto the razor surfaces, and vessel 20*e* last to store the razor. As noted above, storage vessel 20*e* could alternatively be left empty, without any mineral oil, for storing the mineral oil covered razor in air, after it had been rinsed in the mineral oil bath in vessel 20*d*.

Again, the operating life of the mineral oil in the vessel 20*d* and possibly 20*e* should be in excess of several months, and with some care, could be even longer.

In this kit K3, caps 22 as disclosed in FIGS. 1 and 2 can be used on both the mineral oil rinse vessel 20*d* and the storage vessel 20*e*, with the direct linkage between the operating handle 46 and the suspended razor (not shown in this figure); but a cap 52 as disclosed in FIG. 3 and having the motion multiplier between the handle and the suspended razor can be used on the drying vessel 20*c*.

Figure 6:
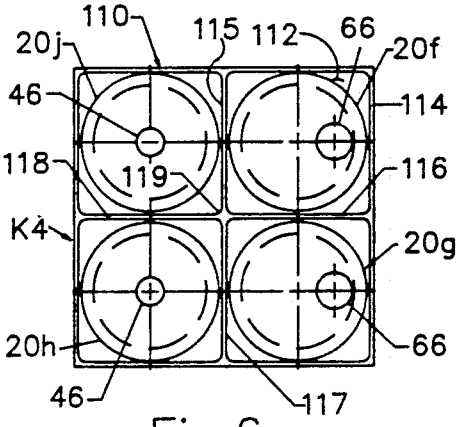
FIGS. 5 and 6 are top plan views of kit type groupings respectively having three and four storage apparatus of the type illustrated in FIGS. 1–3, as might be used in alternative preferred modes of use.

FIG. 6 shows as a top plan view a kit K4 grouping of four vessels 20*f*, 20*g*, 20*h* and 20*j*, held by a tray 110 in a squared side-by-side relationship. The tray 110 may have a flat base wall 112 and a peripherial wall 114 upstanding from the base wall, and four partition walls 115, 116, 117 and 118 also upstanding from the base wall and each extended from one of the sides of the peripherial wall to a central common location 119. Again, the height of each upstanding wall need only be slight.

In kit K4, vessel 20*f* could be empty for merely centrifically spining off the excess water from the surfaces of the used rinsed razor; each vessel 20*g* and 20*h* could hold some mineral oil and hygroscopic material, and vessel 20*j* could be empty. The vessels would be used in a predetermined order, vessel 20*g* first to spin remove excess water mechanically; vessels 20*g* next to flush remaining water off the razor and to work the mineral oil over and onto the razor surfaces, vessels 20*h* next to work the mineral oil even more completely over and onto the razor surfaces, and vessel 20*j* last to store the razor in air after the final mineral oil bath in vessel 20*h*.

When storing the mineral oil coated razor in air within any of the vessels 20*b*, 20*e* or 20*j*, the excess oil may first be centrifically spun off of the razor and collected in the vessel. Also, the closed vessel will be maintained relatively isolated from the exterior atmosphere, with its water vapor and other potentially corrosive components.

In this kit K4, caps 22 as disclosed in FIGS. 1 and 2 can be used on both the final mineral oil rinse vessel 20*h* and storage vessel 20*j*; but caps 52 as disclosed in FIG. 3 and having the motion multiplier between the handle and the suspended razor, can be used on the water drying vessel 20*f* and first mineral oil rinse vessel 20*g*.

Again, the operating life of the mineral oil in the vessels 20*g* and 20*h*, and possibly 20*j*, should be in excess of several months, and with some care, could be even longer. Moreover, the drainage collected off of the razor in vessel 20*j* can be used again, as in the initial oil rinse vessel 20*f*.

While only specific embodiments of the invention have been illustrated, it is apparent that variations may be made therefrom without departing from the inventive concept. Accordingly, the invention is to be limited only by the scope of the following claims.

What is claimed as my invention is:

1. Apparatus for storing, during nonuse, a wet razor having a blade and a handle cantilevered away from the blade, comprising the combination of an open-top vessel;

closure means for the vessel;

razor holding means in the vessel operable to releasably hold the razor blade within the vessel spaced below the closure means therefor;

the combination including said vessel being filled with mineral oil to a level above the blade to have the blade submerged in said mineral oil; and a hygroscopic material contained in the vessel with the mineral oil.

2. Wet razor storage apparatus according to claim 1, further including said razor holding means having a bore for receiving the razor handle and holding it at a substantially normal to the closure means and the open top of the vessel.

3. Wet razor storage apparatus according to claim 2, further including said razor holding means having annular resilient means carried at the bore, adapted to engage and releasibly cooperate with the razor handle.

4. Wet razor storage apparatus according to claim 1, further including the hygroscopic material being as pellets of calcium chloride ($CaCl_2$).

5. Wet razor storage apparatus according to claim 1, further including the combination of a second open-top vessel used as a kit with the first-mentioned vessel during the nonuse storage of the razor, the second vessel also having closure means and razor holding means in the vessel for releasably holding the blade within the vessel spaced below the closure means therefor; and the combination of at least one of the first and second vessels being filled with mineral oil, and when only one of the vessels is filled with mineral oil, of then having the other vessel left empty to allow the razor to be moved from the first vessel to the second vessel successively during its nonuse storage.

6. Wet razor storage apparatus according to claim 1, further including the combination of second and third open-top vessels used as a kit with the first-mentioned vessel during the nonuse storage of the razor, the second and third vessels each also having closure means and razor holding means in the vessel for releasably holding the blade within the vessel spaced below the closure means therefor; and the combination of the second vessel and at least one of the first and third vessels being filled with mineral oil, and when only one of the first and third vessels is filled with mineral oil, of then having the other vessel left empty to allow the razor to be moved successively from the first vessel to second vessel to the third vessel during its nonuse storage.

7. Wet razor storage apparatus according to claim 1, further including the combination of second, third and fourth open-top vessels used as a kit with the first-mentioned vessel during the nonuse storage of the razor, the second, third and fourth vessels each also having closure means and razor holding means in the vessel for releasibly holding the blade within the vessel spaced below the closure means therefor; and the combination of the first and fourth vessels being filled with mineral oil, and the second and third vessels being left empty to allow the razor to be removed from the second vessel for use and to be moved successively from the third vessel to the fourth vessel to the first vessel then back to the second vessel as during its nonuse storage.

8. Wet razor storage apparatus according to claim 1, further including said razor holding means comprising a plug member supported to rotate relative to the closure means generally about an axis disposed substantially normal to the closure means and the open top of the vessel, and drive means exposed from the exterior of the vessel and drivably connected to said plug member operable to allow manually powered rotation of the razor as held in the vessel.

9. Wet razor storage apparatus according to claim 8, further including said razor holding means having a bore for receiving the razor handle and holding it substantially normal to the closure means and the open top of the vessel.

10. Wet razor storage apparatus according to claim 9, further including said razor holding means having annular resilient means carried at the bore, adapted to engage and releasably cooperate with the razor handle, a plug member supported to rotate relative to the closure means generally about an axis disposed substantially normal to the closure means and the open top of the vessel, and drive means exposed from the exterior of the vessel and drivably connected to said plug member operable to allow manually powered rotation of the razor as held in the vessel.

11. Wet razor storage apparatus according to claim 9, further including motion multiplier linkage means interposed between said plug member and said drive means operable to allow high-speed manually powered rotation of the razor as held in the vessel.

* * * * *